United States Patent [19]

Brooks et al.

[11] Patent Number: 4,805,837

[45] Date of Patent: Feb. 21, 1989

[54] INJECTOR WITH SWIRL CHAMBER RETURN

[75] Inventors: Mark A. Brooks, Sterling Heights; Robert Fallis, Milford; Paul Daly, Troy, all of Mich.

[73] Assignee: Allied Corporation, Morris Township, Morris County, N.J.

[21] Appl. No.: 189,457

[22] Filed: May 2, 1988

Related U.S. Application Data

[63] Continuation of Ser. No. 925,780, Oct. 30, 1986, abandoned.

[51] Int. Cl.[4] ..... B05B 1/30; B05B 1/34

[52] U.S. Cl. ..... 239/125; 239/463; 239/585

[58] Field of Search ..... 239/124, 125, 461, 463, 239/585

[56] References Cited

U.S. PATENT DOCUMENTS

| | | | |
|---|---|---|---|
| 1,322,137 | 11/1919 | Salfeld | 239/132.5 |
| 2,549,092 | 4/1951 | Huber | 239/125 |
| 3,241,768 | 3/1966 | Crott | 239/124 |
| 4,007,880 | 2/1977 | Hans et al. | 239/585 |
| 4,060,199 | 11/1977 | Brune et al. | 239/585 |
| 4,120,456 | 10/1978 | Kimura et al. | 239/473 |
| 4,179,069 | 12/1979 | Knapp et al. | 239/585 |
| 4,186,883 | 2/1980 | Robling | 239/491 |
| 4,215,820 | 8/1980 | Renger | 239/125 |
| 4,292,947 | 10/1981 | Tanasawa | 123/445 |
| 4,365,747 | 12/1982 | Knapp et al. | 239/125 |
| 4,625,919 | 12/1986 | Soma et al. | 239/585 |
| 4,653,694 | 3/1987 | Noguchi et al. | 239/473 |

FOREIGN PATENT DOCUMENTS

| | | | |
|---|---|---|---|
| 0200865 | 11/1986 | European Pat. Off. . | |
| 496000 | 8/1930 | Fed. Rep. of Germany . | |
| 3411538 | 10/1985 | Fed. Rep. of Germany . | |
| 1535190 | 8/1968 | France . | |
| 2267458 | 11/1975 | France . | |
| 2417646 | 9/1979 | France . | |
| 8602410 | 4/1986 | PCT Int'l Appl. . | |
| 587420 | 4/1947 | United Kingdom | 239/124 |
| 1085432 | 10/1967 | United Kingdom . | |
| 2088748 | 6/1982 | United Kingdom | 239/DIG. 19 |
| 2090328 | 6/1982 | United Kingdom . | |

OTHER PUBLICATIONS

Patent Abstracts of Japan, vol. 8, No. 180 (M-318)(1617)(Aug. 18, 1984) & JP,A, 5970870 21 Apr. 1984, Hitachi Seisakusho K.K.

Patent Abstracts of Japan, vol. 7 No. 283 (M-263)(1428), 16 Dec. 1983, & JP,A, 58158367 (Mitsubishi Denki K.K.) 20 Sept. 1983.

*Primary Examiner*—Andres Kashnikow
*Assistant Examiner*—Karen B. Merritt
*Attorney, Agent, or Firm*—Markell Seitzman

[57] ABSTRACT

A high pressure vortex fuel injector comprising a hollow housing or body including a plurality of passages at least one of which is adapted to receive fuel through an inlet. The injector also includes a passage for guiding the piston into seating relationship with the valve seat to control the flow of fuel through the metering orifice and a solonoid assembly for moving the piston relative to the valve seat. The injector further includes a swirl or vortex chamber, to angularly accelerate the fuel, formed in cooperation with the first surface of the valve seat. The injector additionally includes passages for permitting fuel to circulate about an electric coil thereof, thereby cooling same during instances when the metering orifice is closed. The injector further includes passages within the swirl chamber for assisting in the rapid formation of a conical spray pattern upon the opening of the metering orifice.

6 Claims, 3 Drawing Sheets

FIG. 2
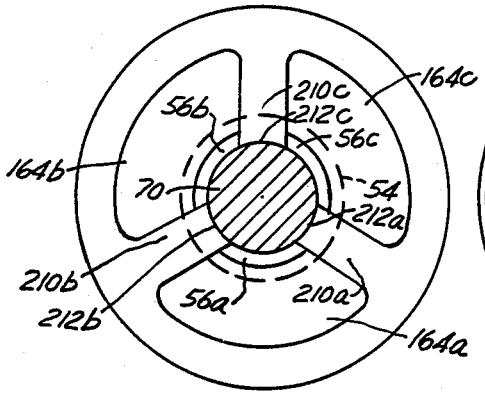
FIG. 3
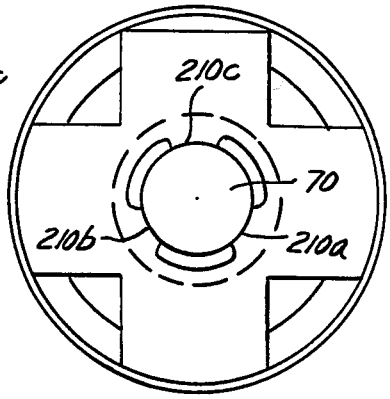
FIG. 4a
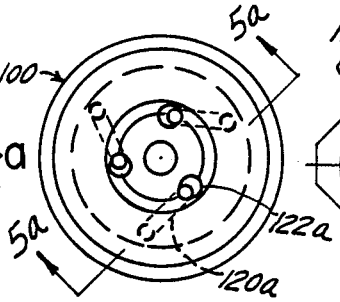
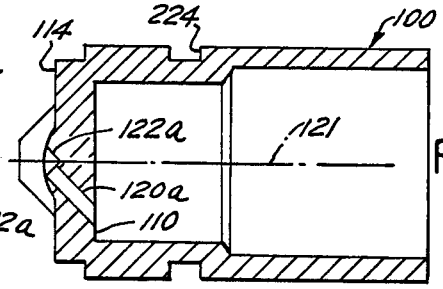
FIG. 5a
FIG. 4b
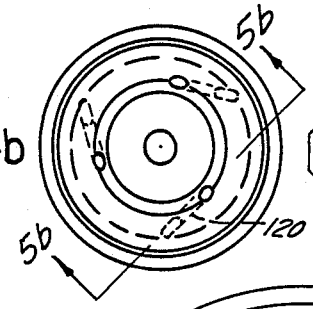
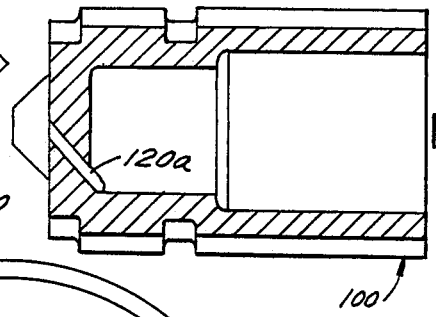
FIG. 5b
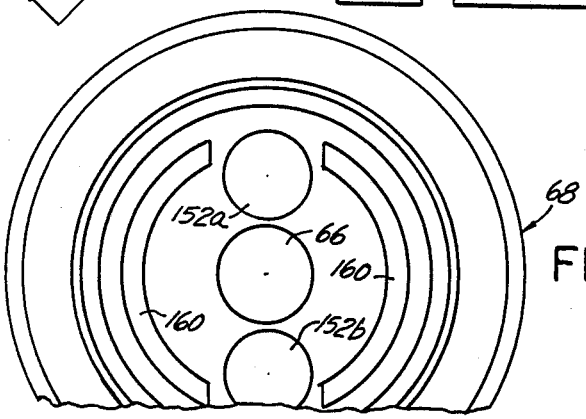
FIG. 6

INJECTOR WITH SWIRL CHAMBER RETURN

This application is a continuation of prior complete application Ser. No. 925,780 filed on Oct. 30, 1986, now abandoned.

BACKGROUND AND SUMMARY OF THE INVENTION

In order to shorten the time to vaporize fuel in a cylinder of an engine it is desirable to introduce fuel having a very fine particle size. In addition, to reduce the level of emissions in an engine, especially a two cycle engine, it is desirous to inject fuel directly into the cylinder. U.S. Pat. No. 2,981,483 illustrates a low pressure fuel injector having a screw thread-like portion proximate its end. As the fuel flows through the helix of the thread it is rotated. The use of such a means to rotate or swirl the fuel does not yield a finely atomized spray and further such type of mechanism is expensive to manufacture.

It is an object of the present invention to inject fuel directly into a cylinder of an engine in a defined swirl or vortex pattern. Another object of the invention is to provide an injector that can inject fuel in a fully filled or partially filled conical swirl pattern. It is yet another object of the invention to provide an injector having a vortex chamber and to continually circulate fuel therein when the injector is closed to enhance the rapid formation of the conical swirl pattern. Still another object of the invention is to provide an injector capable of injecting a variety of different types of fuels, i.e., gas, oil, kerosene etc. Accordingly, the invention comprises:

A high pressure vortex fuel injector comprising a hollow housing or body including a plurality of passages at least one of which is adapted to receive fuel through an inlet. A valve seat is secured to the housing and includes a metering orifice and a first surface disposed directly upstream of the metering orifice. The injector also includes means for guiding the piston into seating relationship with the valve seat to control the flow of fuel through the metering orifice and means for moving the piston relative to the valve seat. The injector further includes means upstream of the metering orifice for forming a swirl or vortex chamber in cooperation with the first surface such that upon removal of the piston from the valve seat, fuel flows out from the metering orifice in a conical spiral manner and means for receiving pressurized fuel and for causing the fuel to enter the vortex chamber in an angular manner. The vortex chamber is so constructed to angularly accelerate the fuel as it flows towards the metering orifice. The injector additionally includes means for permitting fuel to circulate about an electric coil thereof, thereby cooling same during instances when the metering orifice is closed. The injector further includes means for assisting in the rapid formation of a conical spray pattern upon the opening of the metering orifice. Such means includes a flow passage immediately upstream of a valve seating surface. The flow passage is returned to a drain. By locating the flow passage proximate the bottom of the vortex chamber the swirling fuel therein can achieve a large angular velocity even when the metering orifice is closed. Upon opening of the metering orifice this rapidly swirling fuel is immediately ejected forming the spray pattern.

Many other objects and purposes of the invention will be clear from the following detailed description of the drawings.

BRIEF DESCRIPTION OF THE DRAWINGS

In the drawings:

FIGS. 2 and 3 are plan views of various portions of a bobbin.

FIG. 4*a* is a plan view of an insert taken through section 4*a*, 4*b*—4*a*, 4*b* of FIG. 1 illustrating passages within an insert.

FIG. 5*a* is a cross-sectional view of the insert taken through section 5*a*—5*a* of FIG. 4*a*.

FIG. 4*b* and 5*b* illustrate an alternate embodiment of the insert.

FIG. 6 illustrates an isolated plan view of an end cap.

DETAILED DESCRIPTION OF THE DRAWINGS

Figure 1:
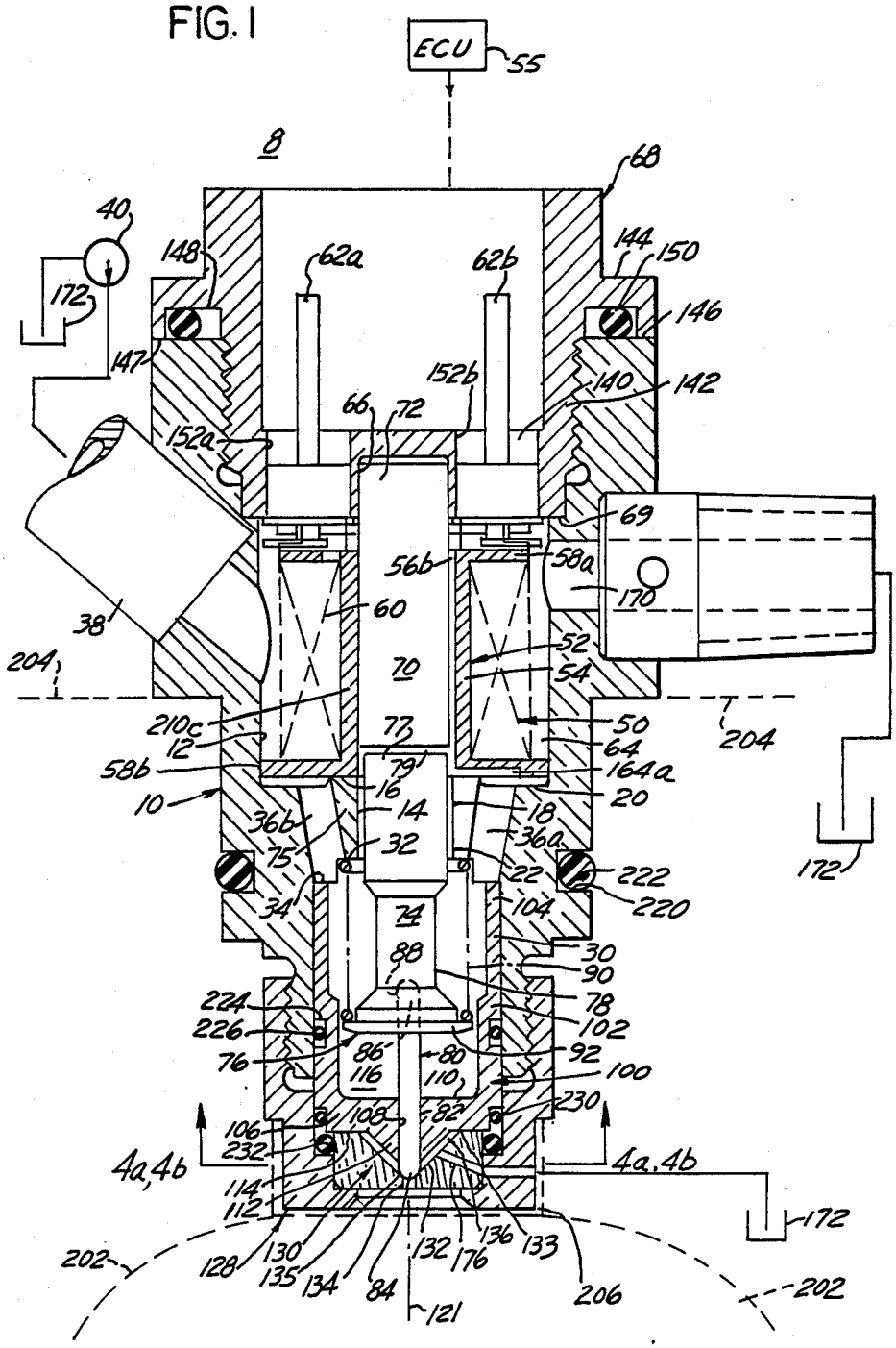
FIG. 1 is a cross-sectional view of a fuel injector and illustrates a number of embodiments of the present invention.

FIG. 1 illustrates a high pressure vortex injector 8 capable of fully atomizing and injecting fuel directly into a cylinder 202 of an engine generally shown as 204 in a full, conical spray pattern. As will be seen below, subject to various minor modifications to the structure and method of control, the injector can also generate a hollow conical spray pattern. FIG. 1 shows three embodiments of the invention, i.e. the preferred embodiment and two alternate embodiments. These alternate embodiments are directed to additional fuel carrying passages which communicate various parts of the injector to a drain and are more fully described below. The fuel injector 8 includes a housing 10 comprising of a upper bore 12 and a first passage 14 in communication therewith. An annular land 16 is situated proximate the bottom of the upper bore 12 about one end 18 of the passage 14. The upper bore 12 further includes an annular recess 20 formed at the bottom thereof about the land 16. The housing 10 further includes a stepped bore 30 situated at a second or other end 22 of the first passage 14. The stepped bore 30 includes a first and a second shoulder 32 and 34 respectively. A plurality of angled fluid passages 36*a–e* communicate the annular recess 20 with the upper extreme of the stepped bore 30. In the preferred embodiment of the invention, five such passages are used, it being understood that the number, size and angle of these passages 32 will vary with the specific application of the invention. A fuel inlet 38 is provided in the housing 10 to receive fuel and to communicate same to the upper bore 12 from a high pressure pump 40.

Positioned within the upper bore 12 is a solenoid assembly 50. The solenoid assembly 50 includes a bobbin 52 which comprises a hollow cylindrical member 54, an upper end 58*a* and a lower end 58*b* radially extending therefrom. An electric coil 60 is wound about the member 54 and is adapted to receive control signals generated by an ECU 55 through a plurality of terminals 62*a* and *b*. Typically the ECU will generate pulsed control signals. By varying the pulse width or duty cycle of these signals the conical spray pattern may vary such as from a fully filled pattern to a partially filled or hollow pattern. The second or lower end 58*b* of bobbin is adapted to be tightly received within the upper bore 12. The upper or first end 58*a*, as well as the exterior diameter of the electric coil 60, are of a smaller diameter than the diameter of the upper bore 12 to provide an annulus 64 between the solenoid assembly 50 and the upper bore to permit fuel to surround the electric coil 60 thereby cooling same.

A metal stator 70 is received within the bobbin 52 and includes a top end 72 extending above the upper end 58*a*. The top end 72 of the stator 70 is received within a blind bore 66 of an end cap 68. The cap 68, in turn, is received on a narrow shoulder 69 of the housing 10. This narrow shoulder in concert with the cap 68 provides a preferred reluctance path for magnetic flux and forms part of the magnetic circuit and provides for a hard metal contact therebetween. It can be shown that by using such a construction, upon activation of the coil 60, the stator 70 is desirably magnetically saturated. The housing and cap may be fabricated of steel such as 430 FR. The securement of the stator 70 to the bobbin is more clearly shown by reference to FIGS. 2 and 3.

FIGS. 2 and 3 show isolated plan views of the upper end 58*a* and lower end 58*b* respectively. In addition, for the purpose of illustration, the stator 70 is also shown. FIGS. 2 and 3 illustrate the outer surface of the member 54, shown in dotted line, about which the coil 60 is wound. The inner surface of the member 54 includes a plurality of radially directed ribs 210*a, b* and *c*. The ends 212 of the ribs 210 are arcuately shaped to receive and secure the stator 70 to the bobbin 52. The rib 210*c* is shown in FIG. 1 and appears as a thickened portion of the left hand wall of the member 54. With the stator 70 positioned within the bobbin 52, the stator 70, the interior wall of the member 54 and the ribs 210 form a plurality of flow passages 56 *a, b* and *c*. Passage 56*b* is illustrated in FIG. 1.

The solenoid assembly 50 further includes an armature assembly 74 comprising a low mass armature 76 which is loosely received with the first passage 14 and partially extends into the center of the bobbin 52 thereby improving the magnetic circuit formed between an interior portion 75 of the housing 10 and solenoid assembly. An upper end 77 of the armature 76 is spaced from the stator 70 thereby defining a working air gap 79. This gap 79 may typically be 0.0038 inches (0.097 mm). The armature 76 and stator 70 may be of a highly magnetically permeable material such as silicon iron (Si Fe) and plated with a thin layer (0.002 in., 0.05 mm) of electrolus nickel or chrome to provide a hard, corrosion resistant, non-magnetic surface. The armature 76 includes a necked-down or narrow portion 78 for reducing the mass thereof. A rod or piston 80 extends from the armature 76. The rod 80 includes a first end 82 which preferably terminates in a spherically shaped valve 84. A second end 86 of the rod 80 may be press fit within a bore 88 of the armature 76. A spring 90 is positioned about the armature 76 and is located between a flanged end 92 thereof and the first shoulder 32 of the housing thereby urging the armature 76 outwardly relative to the stator 70.

The injector 8 further includes an insert 100 comprising an axially extending cylindrical wall 102 open at one end 104. As can be seen from FIG. 1 the insert 100 forms a substantially cup-like member which in concert with the housing 10 forms a fuel receiving chamber 116 in communication with the fluid passages 36*a–e*. Such chamber 116 provides a fuel reservoir or chamber for the pressurized fuel. The cylindrical wall 102 is tightly received within the stepped bore 30 and the open end 104 is forceably lodged against the second or larger diameter shoulder 34 of the housing 10. The insert 100 further includes a bottom element 106 integrally formed with the cylindrical wall 102 opposite the open end 104. The insert 100 includes a third passage 108 for guiding and for slidably receiving the rod or piston 80. The bottom element 106 forms a upper surface 110, interior to the stepped bore 30, and a generally concave protrusion 112 extending axially as part of a lower surface 114. The insert 100 further includes a plurality of non-intersecting fluid passages 120 *a, b,* and *c* which are more clearly as shown in FIGS. 4*a*, 4*b*, 5*a* and 5*b*.

The injector 8 further includes a valve seat 130 positioned below the bottom element 106 comprising a surface 132 which is spaced from and which is preferably conformal to the protrusion 112. In the embodiment illustrated in FIG. 1 the protrusion 112 is conical and the surface 132 is also preferably conically shaped. The valve seat 130 further includes a metering orifice 134 preferably located at the nadir of the surface 132. The insert 100 and valve seat 130 are secured within the housing 10 by an end cap 128. As illustrated in FIG. 1 the end cap 128 is threadably received onto the housing 10; however, such securement may be obtained by many equivalent known means. It can be appreciated that the end cap 128 can be fabricated as an integral portion of the housing 10. As illustrated in FIG. 1 the injector 8 is loosely received within the cylinder 202 forming a narrow annulus 206 therebetween. After extended periods of operation carbon and other particulates will tend to accumulate in the annulus 206. If substantial amounts of carbon is deposited it makes removal of the injector 8 difficult if not impossible. It has been found that if the lower portion of the housing 10 such as the end cap 128 portion is coated with a polymer, such as a polymer in the family including polymide, Mylar and Teflon the injector can be easily withdrawn.

The conically shaped space formed between the valve seat 130 and the projection 112 defines a swirl of vortex chamber 136 for receiving fuel relatively tangentially from the plurality of passages 120*a–c* and assists in swirling and rotationally accelerating same prior to ejection through the metering orifice. Typically, the width or thickness of the vortex chamber 136 will be in the range of 0.003 in. (0.076 mm) to 0.040 in. (1.016 mm). With reference to FIGS. 4*a* and 5*a* the passages 120 extend from the upper surface 110 through to the lower surface 114. Such passages 120 may terminate at enlarged opening 122 proximate the surface 114. The diameter of the passages 120 may vary between 0.015 inch (0.38 mm) to 0.020 inch (0.51 mm). FIG. 4*a* is a plan view of the insert 100 taken in isolation. FIG. 5*a* is a cross-sectional view of the insert 100 taken through section 5*a*—5*a* of FIG. 4*a* and more clearly illustrate the skewed angular orientation of the passages 120. As can be seen the fluid passages 120*a–c* are oriented at a predetermined oblique angle relative to the axis 121 of the injector as well as to the surface 132 of the valve seat 130. In the embodiment of the invention shown in FIG. 1 the protrusion 112 is frusto-conically shaped having a angle of approximately 90° degrees. It is felt that this angle may be varied within the range of 45° degrees to 150° degrees. Correspondingly, the angle of the passages 120 is chosen such that fuel flows radially downward into the swirl chamber 136. As an example, by using a projection 112 having an angle of 90 degrees the orientation of the passages 120 may be at 45 degrees to the axis 121 of the injector. It is not a requirement of the invention that the angle of each of the fluid passages 120*a–c* relative to the conical projection 112, surface 132 or axis 121 be equal. Further, while the preferred embodiment of the invention illustrates the utilization of a separate insert 100, it can be appreciated that the insert and its various components may be formed as an integral part of the housing 12. In addition, it should be appreciated that the projection 112, surface 132 and swirl chamber 136 need not be formed conically, frustoconically or formed by constant angle surfaces. As an example the projection 112, surface 132 and swirl chamber 136 may be spherical or alternatively formed by broadly angled surfaces proximate the passage 108 and metering orifice 134 which transition outwardly to a steeper angle.

Reference is briefly made FIGS. 4*b* and 5*b* which show an alternate embodiment of the insert 100. The passages 120 have been moved outwardly such that they terminate on a larger radius on the surface 114. The angle of these passages has also been increased to approximately 50 degrees. More specifically, the passages 120 terminate about a radius approximately equal to the radius of the shoulder 133 of the valve seat 130. In this manner fuel exiting the passages 120 flows over the shoulder 133 and is broken up or caused to flow turbulently in the swirl chamber. This added turbulence assists within the atomization of the fuel upon exit from the metering orifice 134.

Reference is again made to FIG. 1 and more particularly to the top cap 68. The top cap 68 includes a cylindrical cup-shaped element having a bottom 140 and cylindrical walls 142 extending therefrom. The cylindrical walls threadable engage the housing 10 and include a flanged end 144. A surface 146 of the flange end 144 is in contact with an end 147 of the housing and may include a grove 148 for securing an O-ring 150. The bottom 140 includes a plurality of openings 152*a, b* for receiving the terminals 62*a* and *b*. The terminals 62*a* and *b* extend through the bottom for securement to the ends of the electrical coils 60. Securement can be achieved by soldering or welding.

The bottom 140 includes the blind bore 66 for receiving the top end 72 of the stator 70. The bottom 140 further includes a split annular ring 160 extending from the lower side thereof and positioned about the stator 70 as more clearly shown in FIG. 6, which is an isolated plan view of the cap 68. The ring 160 properly orients the bobbin.

Upon assembly of the cap 68 to the housing 10, the bottom 140 is positioned apart from the upper end 58*a* of the bobbin 52 thereby permitting fuel which is received within the annulus 64 to be communicated to the top portion of the bobbin.

As previously mentioned, the bobbin 52 and stator 70 cooperate to form a plurality of a passages 56 to communicate fuel therebetween. The passages 56 are communicated to the fluid passages 36 formed in the housing 10 and further enhance the cooling of the coil 60. Communication with the passage 36 is achieved by forming a plurality of recesses or slots 164 in the lower end 58*b* of the bobbin as shown in FIG. 2.

The fuel injector 8 has two operational conditions, one being an open condition and the other a closed condition. FIG. 1 illustrates the fuel injector 8 in its closed condition wherein fuel is communicated from the inlet 38 to the annulus 64, through the passages 56, the fluid passages 36 and into the fuel chamber 116. Fuel is thereafter communicated through the fluid passages 120 formed within the insert 100 to the vortex chamber 136. The fuel injector is designed to inject fuel directly into the cylinder of an internal combustion. This is accomplished by suppling fuel at a relatively high pressure, such as 1000–2000 psi or higher (6900 kpa–13,8000 kpa). During the closed mode of operation, each of the various fluid carrying passages and chambers is pressurized to the input pressure. Fuel is prohibited from flowing through the metering orifice by virtue of the fact that the rod 80 and valve 84 formed thereon are positioned against a seating surface 135 of the valve seat 130 by the spring 90. When it is desired to enter the open mode of operation an electrical signal such as a pulse width modulated control signal is applied to the electric coil 60 thereby repeatedly urging the armature 76 and rod 80 off from the valve seat 130. As the rod 80 is moved off from the valve seat 130 pressurized fuel within the fuel chamber 116 flows through the fluid passages 120 against the surface 132 of the valve seat 130 thereby initiating a swirled flow. The swirling fluid is accelerated and exits the metering orifice in a spiral conical manner having a predefined exit cone. Simultaneous with the opening of the valve, the high pressure fuel within the fuel chamber 116 flows or, more specifically, leaks between the rod 80 and the third passage 108 and out through the metering orifice, thereby adding an axial component to the fuel flowing therefrom and assisting in the formation of a fully filled conical spray pattern. The leakage flow passed the rod 80 may be controlled by adding a seal between the insert 100 and the rod 80.

Reference is again made to FIG. 1 which illustrates alternate embodiments of the invention. One such alternate embodiment adds a outflow passage 170 to the housing 10. This passage 170 communicates the annulus 64 with a drain 172 thereby permitting a constant flow of fuel about the coil thereby further cooling the coil even during conditions when injector is closed. FIG. 1 also illustrates another embodiment of the invention wherein another outflow passage 176 is provided in the valve seat 130 and cap 128 to communicate the swirl or vortex chamber 136 with the drain 172. In this manner the fuel residing in the vortex chamber is continuing swirling and upon opening of the metering orifice such swirling fluid is immediately ejected therefrom. Passages 170 and 176 need not be used together.

In each of the above embodiments of the invention a substantial pressure differential exists across the metering orifice 134, and as the fuel exits therefrom it is finely atomized. The spray pattern of the fuel is influenced somewhat by the L/D ratio of the metering orifice and may be varied as the application desires.

To facilitate securement to the walls of the engine's cylinder, the injector 8 may include an annular groove 220 and an O-ring 222 therein. Further, to control fuel leakage between the various mating parts of the injector 8, various other O-rings may be used. As an example, the insert 100 may include an annular groove 224 and O-ring 226. In addition, O-rings 230 and 232 may be provided between the insert 100 and the end cap 128 and the valve seat 130 and the end cap 128.

Figure 7:
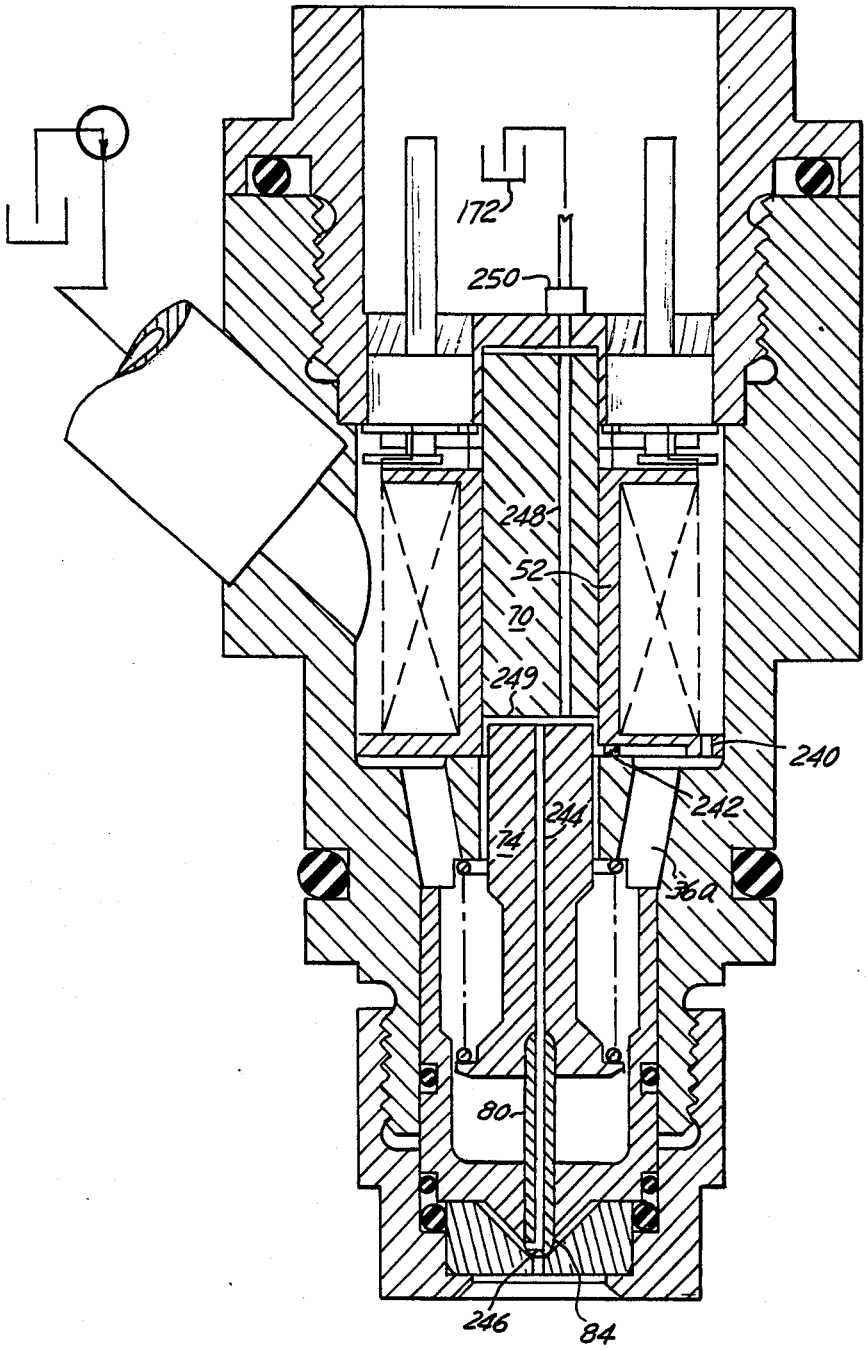
FIG. 7 is another alternate embodiment of the invention.

FIG. 7 illustrates another embodiment of the invention which provides for the continue flow of fuel within the vortex chamber 136. In this embodiment the passages 56 surrounding the stator 70 have been removed. This can be achieved by using a closely fitting cylindrical bobbin 52. An additional flow passage 240 is provided to communicate the annulus 64 with the passages 36 formed within the body 10. A seal 242 is provided to prohibit fuel from flowing from passage 240 into the solenoid assembly 50. The rod 80 and armature 74 are provided with an axial passage 244. The passage 244 does not extend throughout the entire length of the rod 80 but terminates at a cross-hole 246 immediately above the spherical valve surface 84. In this manner the cross-hole 246 is positioned as close as possible to the bottom of the swirl chamber 136. The armature 70 and cap 68 is also provided with an axial passage 248 which terminates at a fitting 250 which is communicated by a appropriate tubing to drain 172. When the injector 8 is closed fuel flows from annulus 64 through passages 240, 36 and 120 into the swirl chamber 136 wherein the fuel is permitted to swirl and achieve a maximum swirl rate before it is returned to drain through the passages 246, 244 and 248. When the coil 60 is activated the armature 74 is moved toward the stator 70. By virtue of the misaligned of passages 244 and 248 the upward movement of the armature 74 seals passages 244 and 248 terminating communication therethrough. As the rod 80 is withdrawn from the valve seat 130 fuel is ejected therefrom. In this manner upon the opening of the injector the fuel proximate the metering orifice 134 will have already achieved a substantial rotational velocity and exits therefrom immediately forming the conical spray pattern.

We claim:

1. A high pressure vortex fuel injector comprising a hollow housing or body including a plurality of passages at least one of which is adapted to receive fuel through an inlet;

a valve seat secured to said housing, including a metering orifice, a first surface disposed directly upstream of said metering orifice;

means for guiding a piston into seating relationship with said valve seat;

means for moving said piston relative to said valve seat;

means, fixedly positioned upstream of said first surface, for forming a constant dimension swirl or vortex chamber in cooperation with said first surface such that upon removal of said piston from said valve seat, fuel flows out from said metering orifice in a conical spiral manner, including a plurality of passages, obliquely situated relative to said first surface, for receiving pressurized fuel and for causing said fuel to enter said vortex chamber in a helical, spiraling down manner;

means for causing fuel to flow within said swirl chamber during instances when said injector is closed, wherein said moving means includes a stator and an electro-magnetically movable armature substantially axially aligned with the movable through an air gap relative to said stator said piston comprising a cylindrical rod extending from said armature and of a diameter substantially smaller than said armature;

said flow means including first passage means within said armature and said piston for communicating said swirl chamber to an end of said armature remote from said piston, said end adapted to seat against an oppositely positioned surface of said stator when the injector is activated; and second passage means, for communicating said first passage means to a drain.

2. The injector as defined in claim 1 wherein said first passage means includes a first axial passage through said armature and piston, said first passage terminating at a cross-hole in said piston, said cross-hole positioned at the lower extreme of said piston proximate the lower extreme of said swirl chamber, and wherein said second passage means includes second passage means through said stator off-set from said first passage for preventing fluid flow from said swirl chamber during instances when the injector is activated.

3. The injector as defined in claim 1 wherein the size of said oblique passages, swirl chamber and air gap are arranged such that when the injector is activated the most significant pressure drop occurs due to the throttling of the fluid as it flows between the piston and the first surface prior to exiting through the metering orifice.

4. The injector as defined in claim 3 wherein the diameter of said passages is between the range of 0.015 inch (0.38 mm) to 0.20 inch (0.51 mm), the air gap is approximately 0.0038 inch (0.097 mm) and the spacing between said first surface and said valve seat is in the range of 0.003 inch (0.076 mm) to 0.040 inch (1.016 mm).

5. A high pressure vortex fuel injector comprising a hollow housing or body including a plurality of passages at least one of which is adapted to receive fuel through an inlet;

a valve seat secured to said housing, including a metering orifice, a first surface disposed directly upstream of said metering orifice;

means for guiding a piston into seating relationship with said valve seat;

means for moving said piston relative to said valve seat;

means, fixedly positioned upstream of said first surface, for forming a constant dimension swirl or vortex chamber in cooperation with said first surface such that upon removal of said piston from said valve seat, fuel flows out from said metering orifice in a conical spiral manner, including a plurality of passages, obliquely situated relative to said first surface, for receiving pressurized fuel and for causing said fuel to enter said vortex chamber in a helical, spiraling down manner;

means for causing fuel to flow within said swirl chamber during instances when said injector is closed wherein said flow means includes an exit passage within said valve seat immediately upstream of a valve seating surface, such exit passage communicating said swirl chamber to said drain.

6. A fuel injector comprising:

a narrow generally annular shaped chamber including fixed, spaced upper and lower surfaces positioned immediately upstream of a metering orifice, for receiving fuel and for rotationally accelerating same in a helical manner toward said metering orifice;

a piston received through an opening in the upper surface of said chamber;

said piston including a valve end adapted to sealably engage the lower surface of said chamber, at a valve seat portion thereof, wherein engagement of said valve end with said lower surface prohibits fuel from flowing from the chamber through said metering orifice.

means for reciprocatively moving said piston to open and close said injector;

a plurality of passages for communicating fuel to said chamber, one of said plurality of passages including a first plurality of flow passages obliquely situated relative to said lower and upper surfaces, upstream of said chamber, for causing fuel to impact said lower surface in a generally tangential manner having a component of fuel flow directed toward said metering orifice, such that upon opening of said injector fuel is caused to flow out of said metering orifice in a swirling conically shaped pattern, wherein said flow means includes a fuel outlet passage immediately upstream of said valve seat and extending through said lower surface to a drain.

* * * * *